US005516617A

United States Patent [19]

Petropoulos et al.

[11] Patent Number: 5,516,617

[45] Date of Patent: May 14, 1996

[54] PHOTORECEPTOR MATERIAL RECLAIM METHOD

[75] Inventors: Mark C. Petropoulos, Ontario; April M. Mattox, Webster; Martha J. Stegbauer, Ontario; Richard J. Manzolati, Rochester; John F. Yanus, Webster, all of N.Y.

[73] Assignee: Xerox Corporation, Stamford, Conn.

[21] Appl. No.: 502,730

[22] Filed: Jul. 14, 1995

[51] Int. Cl.[6] ..... G03G 5/04

[52] U.S. Cl. ..... 430/133; 430/135; 209/159; 209/645

[58] Field of Search ..... 430/133, 135; 209/159, 645

[56] References Cited

U.S. PATENT DOCUMENTS

| | | | |
|---|---|---|---|
| 4,159,942 | 7/1979 | Greer et al. | 209/143 |
| 4,759,943 | 7/1988 | Ross, Jr. | 426/646 |
| 5,141,837 | 8/1992 | Nguyen et al. | 430/135 |
| 5,186,872 | 2/1993 | Nishiwaki et al. | 264/5 |

FOREIGN PATENT DOCUMENTS

| | | | |
|---|---|---|---|
| 304263 | 12/1988 | Japan | 430/135 |

*Primary Examiner*—Roland Martin
*Attorney, Agent, or Firm*—Zosan S. Soong

[57] ABSTRACT

There is disclosed a photoreceptor material reclaim method comprising: (a) centrifuging a first photoreceptor coating solution comprised of a liquid, a photoreceptor material, and impurities, resulting in a residue composition comprised of a lower density material including a portion of the photoreceptor material and a higher density material including a portion of the impurities and a supernatant composition; (b) drying the residue composition to remove a portion of the liquid in the residue composition; (c) grinding the dried residue composition; (d) separating the lower density material from the higher density material of the dried, ground residue composition; (e) forming a second photoreceptor coating solution comprised of the lower density material obtained by (d); and (f) depositing the second photoreceptor coating solution comprised of the lower density material on a substrate.

10 Claims, No Drawings

PHOTORECEPTOR MATERIAL RECLAIM METHOD

This invention relates generally to a method to reclaim a photoreceptor material, and more particularly to a method to reclaim a pigment like dibromoanthanthrone from a centrifuge produced residue composition.

A coating solution to form for example a charge generating layer on a substrate may be prepared by mixing together a pigment like dibromoanthanthrone, a polymeric binder like polyvinylbutyral, an additive like trifluoroacetic acid, and a liquid like cyclohexanone. The coating solution may be subjected to grinding in a ball mill or a dyna mill to minimize particle agglomerations (such as agglomerations of pigment particles) which may be considered one type of impurity. Another impurity in the coating solution may be metal particles like iron particles, which can come from the milling process (from for example the steel shot used). Another possible source for the metal particles may be the pigment supplied from the vendor, wherein the metal particles may be mixed with the pigment. The coating solution containing the impurities, i.e., pigment particle agglomerations and/or metal particles, may be purified by centrifuging to result in a residue composition containing the impurities and the supernatant composition. Removal of the impurities is needed to minimize coating imperfections and adverse effects on the performance characteristics of the coated layer. The residue composition is typically discarded. However, discarding the residue composition is wasteful since it may contain a significant amount of the pigment, perhaps up to about 50% of the pigment in the coating solution. Thus, there is a need for a method to reclaim a photoreceptor material from a centrifuge produced residue composition.

Conventional separation methods are illustrated in for example Ross, Jr., U.S. Pat. No. 4,759943 and Greer et al., U.S. Pat. No. 4,159,942. Nishiwaki et al., U.S. Pat. No. 5,186,872 describes a method for the generation and collection of ultra fine particles without scatter.

SUMMARY OF THE INVENTION

It is an object of the invention in embodiments to provide a method to reclaim a photoreceptor material such as a photoconductive pigment like dibromoanthanthrone from a centrifuge produced residue composition.

This object and others are accomplished in embodiments by providing a photoreceptor material reclaim method comprising:

(a) centrifuging a first photoreceptor coating solution comprised of a liquid, a photoreceptor material, and impurities, resulting in a residue composition comprised of a lower density material including a portion of the photoreceptor material and a higher density material including a portion of the impurities and a supernatant composition;

(b) drying the residue composition to remove a portion of the liquid in the residue composition;

(c) grinding the dried residue composition;

(d) separating the lower density material from the higher density material of the dried, ground residue composition;

(e) forming a second photoreceptor coating solution comprised of the lower density material obtained by (d); and (f) depositing the second photoreceptor coating solution comprised of the lower density material on a substrate.

DETAILED DESCRIPTION

The photoreceptor coating solution (referred herein also as "coating solution") may be prepared by any conventional method and apparatus such as by mixing together the various components for a time ranging from for instance about 3 to about 5 hours and at a mixing speed ranging for instance from about 100 to about 200 rpm. The components of the coating solution may be present in any effective proportion. For example, the photoreceptor material may be present in an amount ranging for example from about 5 to about 10 weight percent and preferably from about 7 to about 9 weight percent; the liquid may be present in an amount ranging for example from about 70 to about 95 weight percent and preferably from about 80 to about 90 weight percent; the polymeric binder may be present in an amount ranging for example from about 5 to about 10 weight percent and preferably from about 7 to about 9 weight percent; and additives such as trifluoroacetic acid may be present in an amount ranging for example from about 2 to about 5 weight percent and preferably from about 3 to about 4 weight percent.

The coating solution is subjected to grinding in for example a dyna mill to minimize particle agglomerations and/or reduce the particle size. Illustrative grinding conditions are as follows: a grinding speed ranging for example from about 1,000 to about 5,000 rpm, and preferably from about 2,000 to about 3,000 rpm; and a grinding time ranging for example from about 1 hour to about 20 hours, and preferably from about 3 hours to about 5 hours. Grinding equipment may be purchased from Dynamill, Union Process, and Chicago Boiler.

The coating solution is centrifuged to produce a residue composition and a supernatant composition. The residue composition comprises a portion of the impurities such as metal particles and/or particle agglomerations. Preferably, substantially all of the impurities, perhaps all of the impurities in embodiments, are concentrated in the residue composition. The coating solution of the supernatant composition may be deposited on a substrate. Centrifuging may be accomplished at a speed ranging for example from about 100 to about 1000 rpm, preferably from about 200 to about 500 rpm, and especially about 300 rpm. The coating solution may be centrifuged for any suitable period of time, ranging for example from about 10 minutes to about 2 hours, preferably from about 15 minutes to about 1 hour, and especially about 30 minutes.

The resulting residue composition is dried to remove a portion of the liquid remaining in the residue composition. Preferably, the residue composition is dried to remove all of the liquid. The residue composition may be dried in an oven at a temperature ranging for example from about 80° C. to about 140° C., preferably from about 100° C. to about 120° C., and especially about 110° C., and for a time ranging for example from about 10 hours to about 48 hours, preferably from about 20 hours to about 30 hours, and especially about 24 hours. Preferably, drying of the residue composition results in a brittle material which facilitates the subsequent grinding process.

The dried residue composition is subjected to grinding by for example mortar and pestle, ball milling, or dyna milling to minimize or eliminate particle agglomerates. Grinding may occur for a length of time ranging for example from about 1 hour to about 7 hours, preferably about 2 to about 5 hours, and especially about 5 hours at the conditions described herein. In particular, grinding may occur using grinding media such as 1 mm ceramic balls at 3,500 rpm (about 5 hours grinding time).

The residue composition is comprised of lower density material and higher density material. The lower density material comprises the photoreceptor material, the polymeric binder, remaining liquid, and perhaps small amounts of other components of the photoreceptor coating solution such as for example the additive trifluoroacetic acid. The higher density material includes impurities such as metal particles and particle agglomerations of the photoreceptor material (the grinding process may minimize the amount of particle agglomerations).

The lower density material is separated from the higher density material of the dried, ground residue composition by applying for example vibrational energy or vibrational energy and gravitational force. Thus, separation may be based on differing material density. The lower density material isolated from the residue composition may be comprised primarily of the photoreceptor material, preferably from about 50 to about 95 weight percent. The amount of the photoreceptor material reclaimed or recovered from the residue composition may range for example from about 50% to about 95% by weight, and preferably from about 60% to about 80% by weight based on the total weight of the photoreceptor material in the residue composition. Any suitable method and apparatus may be used including, for example, hand vibration of a pestle and an ultrasonic vibratory bowl. The principle of separating by a difference in density is as follows: If one had a mixture of sand and flour and put it into a cup, then vibrated on a table, the dense sand would go the bottom and the flour would go to the top; one could take that same cup and partially submerge it into water in an ultrasonic cleaning tank and get the same results where the water would transmit the vibration to the cup and separation would occur. Ultrasonic systems are available from the NEY System Inc.

The lower density material may be added and mixed along with other suitable components such as those components described herein to form a coating solution like for example a charge generating solution. These components may include for example the polymeric binder, the liquid, and additives such as trifluoroacetic acid. The photoreceptor material present in the coating solution may be entirely reclaimed photoreceptor material. In embodiments of the invention, a portion of the photoreceptor material present in the coating solution, ranging for example from about 10% to about 60% by weight, preferably from about 20% to about 40% by weight, is reclaimed photoreceptor material; the remaining portion, ranging for example from about 90% to about 40% by weight, preferably from about 80% to about 60% by weight, is additional photoreceptor material (referred herein as "non-reclaimed photoreceptor material") which is not reclaimed from the residue composition.

Prior to deposition on the substrate, the coating solution may be filtered to remove filterable impurities such as fibers, dirt, skin flakes, and the like. Filtering apparatus such as high purity filters in the 5 microns to 20 microns range is available from for example Pall Company and Filter Right Company.

In embodiments where the reclaimed photoreceptor material is added to a coating solution containing non-reclaimed photoreceptor material, the coating solution may be optionally subjected to further processing including for example one or more of the following: grinding in for example a dyna mill to minimize or eliminate particle agglomerations as described herein; centrifuging as described herein and removing the residue composition while retaining the supernatant composition; and filtering the coating solution to remove filterable impurities as described herein.

The coating solution may be deposited on the substrate by any known technique and apparatus including dip coating, spray coating, electrodeposition, blade coating, roll coating, and vapor deposition. Compositions of the materials described herein and techniques and apparatus for their application to the substrate are illustrated in U.S. Pat Nos. 4,390,611, 4,551,404, 4,588,667, 4,596,754, and 4,797,337, the disclosures of which are totally incorporated by reference. The coating solution is applied as a layer in an effective thickness on the substrate surface, wherein the deposited layer ranges in thickness for example from about 1 micron to about 1 ml.

The photoreceptor material may be a charge generating material and/or a charge transport material such as those illustrated for instance in U.S. Pat. Nos. 4,265,990, 4,390,611, 4,551,404, 4,588,667, 4,596,754, and 4,797,337, the disclosures of which are totally incorporated by reference. Charge generating materials may be photoconductive organic pigments including for example azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; and azulene compounds. Preferred charge generating materials are polycyclic quinones represented by dibromoanthanthrone, pyrylium compounds, and eutectic complexes thereof, squarium compounds, phthlocyanine compounds and azo compounds.

In embodiments of the instant invention, the photoreceptor material may be a photoconductive inorganic pigment such as selenium, selenium-arsenic alloy, selenium-tellurium alloy or cadmium sulfide.

The photoreceptor material may be a charge transport material including for instance compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds The polymeric binder material includes for example polyester, polystyrene, polyvinylbutyral, polyvinyl pyrrolidone, methyl cellulose, polyacrylates, cellulose esters, polycarbonate, polymethacrylates, polyarylate, polysulfone, styrene-acrylonitrile copolymer, styrene-methyl methacrylate copolymer, and the like.

The liquid or solvent may be any medium typically employed for a charge transport solution or a charge generating solution. Illustrative liquids include for example: alcohols such as methanol, ethanol, and isopropanol, as well as others described herein; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofuran, dioxane, and ethylene glycol monomethyl ether; esters such as methyl acetate and ethyl acetate; aliphatic halogenohydrocarbons such as chloroform, methylene chloride, dichloroethylene, carbon tetrachloride and trichloroethylene; or aromatic compounds such as benzene, toluene, xylene, ligroin, monochlorobenzene, and dichlorobenzene. Preferred solvents include cyclohexanone and N-butyl acetate.

Other additives that may be present in the coating solution include for example trifluoroacetic acid.

The substrate may be bare of layered material prior to deposition of the coating solution or already may be coated with a layered material. The substrate may be of any effective cross sectional shape including oval and circular. Preferably, the substrate is in the form of a hollow cylinder or a belt. The substrate may be fabricated from a metal such as stainless steel, nickel, aluminum, copper, or iron or a polymeric material such as graphite loaded phenolics, carbon black loaded polyesters, and carbon black loaded acetals.

Other modifications of the present invention may occur to those skilled in the art based upon a reading of the present disclosure and these modifications are intended to be included within the scope of the present invention.

We claim:

1. A photoreceptor material reclaim method comprising:

(a) centrifuging a first photoreceptor coating solution comprised of a liquid, a photoreceptor material, and impurities, resulting in a residue composition comprised of a lower density material including a portion of the photoreceptor material and a higher density material including a portion of the impurities and a supernatant composition;

(b) drying the residue composition to remove a portion of the liquid in the residue composition;

(c) grinding the dried residue composition;

(d) separating the lower density material from the higher density material of the dried, ground residue composition;

(e) forming a second photoreceptor coating solution comprised of the lower density material obtained by (d); and (f) depositing the second photoreceptor coating solution comprised of the lower density material on a substrate.

2. The method of claim 1, wherein the impurities comprise metal particles and particle agglomerates of the photoreceptor material and (a) centrifuges the portion of the impurities into the residue composition as the higher density material.

3. The method of claim 1, wherein the photoreceptor material is dibromoanthanthrone.

4. The method of claim 1, wherein (b) is accomplished by drying the residue composition at a temperature ranging from about 80° C. to about 140° C.

5. The method of claim 1, wherein (b) removes all of the liquid in the residue composition.

6. The method of claim 1, wherein (c) is accomplished by grinding the dried residue composition in a ball mill or a dyna mill.

7. The method of claim 1, wherein (d) is accomplished by applying vibrational energy.

8. The method of claim 1, further comprising filtering the second photoreceptor coating prior to (f).

9. The method of claim 1, further comprising grinding the second photoreceptor coating solution and centrifuging the ground second photoreceptor coating solution prior to (f).

10. The method of claim 1, wherein (f) comprises depositing the second photoreceptor coating solution on a substrate to form a charge generating layer.

* * * * *